US005351582A

United States Patent [19]

Snyder et al.

[11] Patent Number: 5,351,582

[45] Date of Patent: Oct. 4, 1994

[54] PIPE TURNING TOOL

[75] Inventors: Edwin Snyder, Wadsworth; L. Warren Aldridge, Libertyville, both of Ill.

[73] Assignee: Aldridge Electric Inc., Libertyville, Ill.

[21] Appl. No.: 940,675

[22] Filed: Sep. 4, 1992

[51] Int. Cl.[5] ..... B25B 17/00

[52] U.S. Cl. ..... 81/57.17; 81/57.13; 81/57.34; 81/57.16; 81/57.42

[58] Field of Search ..... 81/57.15, 57.17, 57.3, 81/57.33, 57.34, 186, 57.13, 57.21, 57.42, 57.46, 57.16

[56] References Cited

U.S. PATENT DOCUMENTS

| | | | |
|---|---|---|---|
| 1,760,167 | 5/1930 | Palmer | 81/57.17 |
| 2,374,192 | 4/1945 | Godfrey | 81/186 X |
| 2,753,744 | 7/1956 | Therien | 81/57.13 X |
| 2,895,365 | 7/1959 | Myers et al. | 81/186 |
| 3,668,949 | 6/1972 | Walker | 81/57.46 X |
| 3,774,481 | 11/1973 | Goodman | 81/57.17 X |
| 3,799,010 | 3/1974 | Guier . | |
| 3,988,952 | 11/1976 | Dirks | 81/57.21 X |
| 4,221,269 | 9/1980 | Hudson . | |
| 4,372,026 | 2/1983 | Mosing . | |
| 4,446,761 | 5/1984 | Boyadjieff et al. . | |
| 4,604,922 | 8/1986 | Soutsos . | |
| 4,774,861 | 10/1988 | Hamilton et al. | 81/57.33 |
| 4,843,924 | 7/1989 | Hauk . | |
| 4,898,051 | 2/1990 | Easter et al. . | |

FOREIGN PATENT DOCUMENTS

| | | | |
|---|---|---|---|
| 480401 | 1/1952 | Canada | 81/57.17 |

*Primary Examiner*—James G. Smith

*Attorney, Agent, or Firm*—Wood, Phillips, VanSanten, Hoffman & Ertel

[57] ABSTRACT

A tool for turning an elongate pipe is disclosed. The tool comprises a base and a drive wheel mounted for rotation on the base. The drive wheel has a cylindrical outer surface may include a plurality of projections extending radially outward from the outer surface of the first drive wheel. The projections extend past the edge of the base. In use, the projections contact a portion of the outer surface of an elongate pipe and turn the pipe with the rotation of the drive wheel. A guide is also mounted for movement on the base. The guide may be a pair of guide arms pivotally mounted on the base. Each guide arm has a free end and a guide roller is mounted for free rotation at each free end of each guide arm. Each guide arm is pivotable to a position wherein the guide rollers hold the elongate pipe against the projections on the outer surface of the first drive wheel. The guide may also be an L-shaped guide arm with a free leg carrying guide rollers to hold the elongate pipe against the projections on the outer surface of the drive wheel. The drive wheel may be driven by a motor, such as a hydraulic motor.

20 Claims, 3 Drawing Sheets

PIPE TURNING TOOL

BACKGROUND OF THE INVENTION

The present invention is directed to facilitating the installation of threaded pipe. More particularly, the present invention is directed to facilitating the installation of threaded pipe in confined areas, such as those present in a bank of electrical duct work, in areas that are difficult or awkward to reach, such as under a bridge, in elevated areas, and to facilitating the installation of cumbersome pipe, such as a three or four inch diameter pipe that, because of its weight and size, is not easily manipulated by one or two workers.

Frequently, large diameter threaded pipe must be installed in closely confined areas, where large scale tools cannot easily be used, such as when installing pipe in a bank of electrical ducts, where the pipes are closely spaced. It also frequently occurs that such pipe must be installed above ground or at an unusual attitude or where it is difficult to fit a "man-basket" device in installing the pipe, such as under a bridge or above the workers' heads. In such circumstances, the weight and unwieldiness of such pipe also presents handling problems. Conventionally, in making such installations in electrical duct banks, the mating pipe ends are threaded together by use of pipe wrenches or chain wrenches. However, such tools are difficult to use effectively in such environments, because of the frequently encountered tight and awkward working conditions where conventional tools may not be easily or efficiently used, and because of the strength and dexterity required to position and turn the pipe to effect the proper connection. These problems may be aggravated by the weight and size of the such a pipe, which may make it difficult for a worker to move and position the pipe without some assistance, such as from a second or third worker.

SUMMARY OF THE INVENTION

It is an object of the present invention to provide a powered tool for turning pipe to effect a threaded connection between the ends of adjacent pipes.

It is a further object of the present invention to provide such a tool that facilitates movement and positioning of large diameter pipe in the workplace.

It is a further object of the present invention to provide such a tool that fits within the spaces between pipes in electrical duct banks such as duct banks held together by spacers.

It is a further object of the present invention to provide such a tool that allows a single worker to manipulate a large diameter pipe.

It is a further object of the present invention to provide such a tool that can be attached to a variety of manipulator arm devices.

It is a further object of the present invention to provide such a tool that can be used to position and turn a pipe at an unusual attitude.

It is a further object of the present invention to provide such a tool that can be used to position and turn a pipe above the worker's head.

It is a further object of the present invention to provide such a tool that can be used to position and turn a pipe in a location where a "man-basket" device will not fit.

These and other objectives of the invention are achieved in the illustrated embodiments. In one aspect, the present invention provides a tool for turning an elongate pipe, the tool comprising a base and a first drive wheel mounted for rotation on the base. Means for rotating the first drive wheel are included in the tool and a guide means is attached to the base for movement to a position wherein a pipe is held against the first drive wheel.

The tool may be a hand held tool or may be adapted to be mounted or connected to a manipulator arm. In the hand held embodiment, the guide means comprises an L-shaped guide arm having a free leg opposite the drive wheel. The guide arm is reciprocatable on the base to increase and decrease the distance between the drive wheel and the free leg of the guide arm.

In the other embodiment, a pair of guide arms is pivotally mounted on the base. Each guide arm has a free end and a guide roller is mounted for free rotation at each free end of each guide arm. Each guide arm is pivotable to a position wherein the guide rollers hold the elongate pipe against the projections on the outer surface of the first drive wheel.

In both of these embodiments, the first drive wheel has a cylindrical outer surface and may include a plurality of projections extending radially outward from the outer surface of the first drive wheel. The projections extend past the edge of the base. In use, the projections contact a portion of the outer surface of an elongate pipe and turn the pipe with the rotation of the first drive wheel. Means for rotating the first drive wheel may also be provided.

The projections may comprise a plurality of points extending outwardly from the outer surface of the drive wheel, the projections being staggered and spaced so that the effective outer diameter of the drive wheel is at the pointed ends of the projections. The projections may be pointed inserts that fit within complementary holes in the outer surface of the drive wheel. A second drive wheel may also be provided, with similar projections similarly arrayed.

In another aspect, the present invention provides a tool for turning an elongate pipe, the tool comprising a base having a bottom edge and a pair of guide arms, each guide arm having a free end. Means are provided for pivotally mounting each guide arm to the base, each guide arm being mounted so that the free ends of the guide arms extend beyond the base. At each free end of each guide arm, a guide roller is mounted for free rotation. A first drive wheel is mounted for rotation on the base, the drive wheel being positioned so that a portion of the outer surface of the drive wheel extends beyond the bottom edge of the base, the drive wheel serving to frictionally engage the outer surface of the elongate pipe to turn the elongate pipe with rotation of the drive wheel. The guide arms are pivotable on the base between a first position wherein the free ends of the guide arms are spaced from each other a distance greater than the diameter of the elongate pipe and a second position wherein the free ends of the guide arms are spaced from each other a distance less than the diameter of the elongate pipe and spaced from the drive wheel to capture the elongate pipe between the drive wheel and guide rollers at the free ends of the guide arms.

In this embodiment, a pair of toggle arms are pivotally connected in an end to end relationship, with a toggle arm pivot Joint connecting the two adjacent ends of the toggle arms. The opposite ends of the guide arms are pivotally connected to the toggle arms by guide arm pivot joints. The toggle arm pivot joint and guide arm pivot joints have parallel axes of rotation. A reciprocatable ram is connected to the toggle arm pivot joint. The invention further includes means for driving the reciprocatable ram to move in a direction perpendicular to the axes of rotation of the toggle arm pivot joint and guide arm pivot joints to cause the guide arms to pivot between the first and second positions.

In another aspect, the present invention provides a tool for turning an elongate pipe, the tool comprising a first and a second end unit, with a rod connecting the end units. The first end unit includes a base and a pair of guide arms, each guide arm having a free end. The first end unit also includes means for pivotally mounting each guide arm to the base, each guide arm being mounted so that the free ends of the guide arms extend beyond the base. A guide roller is mounted for free rotation at each free end of each guide arm. The first end unit also includes a first drive wheel mounted for rotation on the base. The first drive wheel has a cylindrical outer surface and includes a plurality of projections extending radially outward from the outer surface of the first drive wheel. The first drive wheel is positioned on the base so that the projections extend past the edge of the base for contacting a portion of the outer surface of an elongate pipe and for turning the pipe with the rotation of the first drive wheel. The guide arms are pivotable on the base between a first position wherein the free ends of the guide arms are spaced from each other a distance greater than the diameter of the elongate pipe and a second position wherein the free ends of the guide arms are spaced from each other a distance less than the diameter of the elongate pipe and spaced from the drive wheel to capture the elongate pipe between the drive wheel and guide rollers at the free ends of the guide arms. The second end unit includes means for supporting the elongate pipe. The second end unit may be the same as the first end unit, with the same form of guide arms and drive wheel. The supporting means allows for rotation of the pipe. The tool includes means for rotating the first drive wheel.

In any of the above aspects, means for connecting the tool to a manipulator arm may be included so that the tool may be attached to a back hoe arm, a "man-basket" device or to the arm of a robotic device.

DETAILED DESCRIPTION OF THE ILLUSTRATED EMBODIMENT

One embodiment of the pipe positioning and turning tool 10 of the present invention includes two identical end units 12 connected by spaced parallel rods 14. The end units 12 each include structures to allow for grabbing and holding an elongate pipe 16, as well as for turning the pipe to connect the pipe to another pipe. The end units 12 are coaxial, with the common axis parallel to the rods 14.

Figure 1:
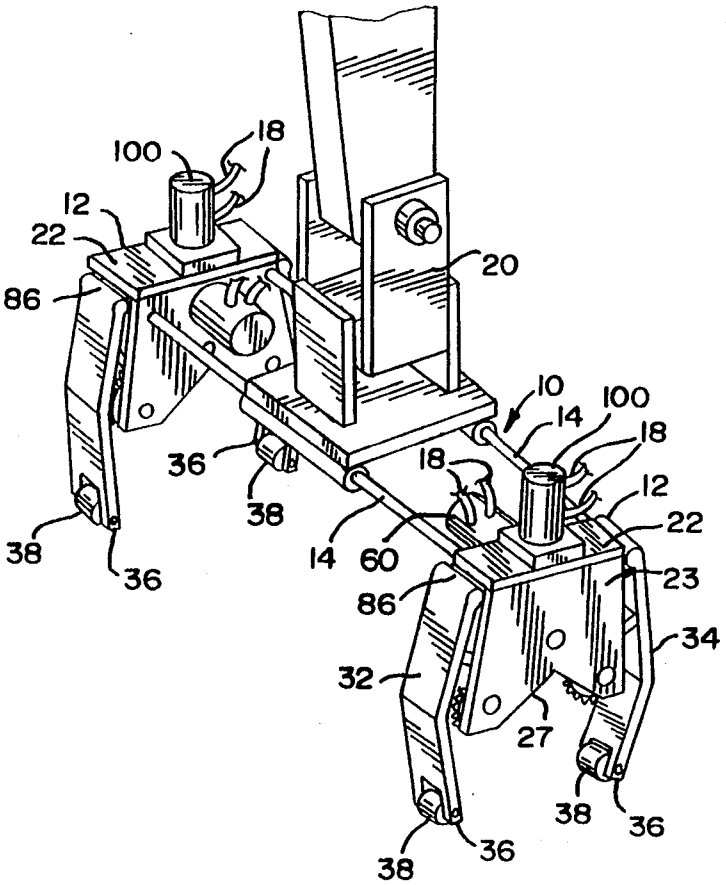
FIG. 1 is a perspective view of an embodiment of the pipe turning tool of the present invention.

The illustrated pipe positioning and turning tool includes hydraulic power means for driving the structures of the end units. The hydraulic power means delivers fluid through hydraulic fluid lines 18, as shown in FIG. 1. At the center of the tool 10, a connecting means 20 such as an apertured bracket may be secured to the spacer rods 14, so that the tool may be hung on the end of a back hoe armor similar device so that the back hoe or the like may be used for lifting, moving and positioning a pipe held by the tool. As will be understood by those skilled in the art, the illustrated pipe positioning and turning tool may also be attached to other manipulator arm devices, such as at the end of a robotic structure or to man-basket devices and the like. The illustrated pipe positioning and turning tool may also be advantageously fixed to a platform and used to build a long length of pipe.

Figure 2:
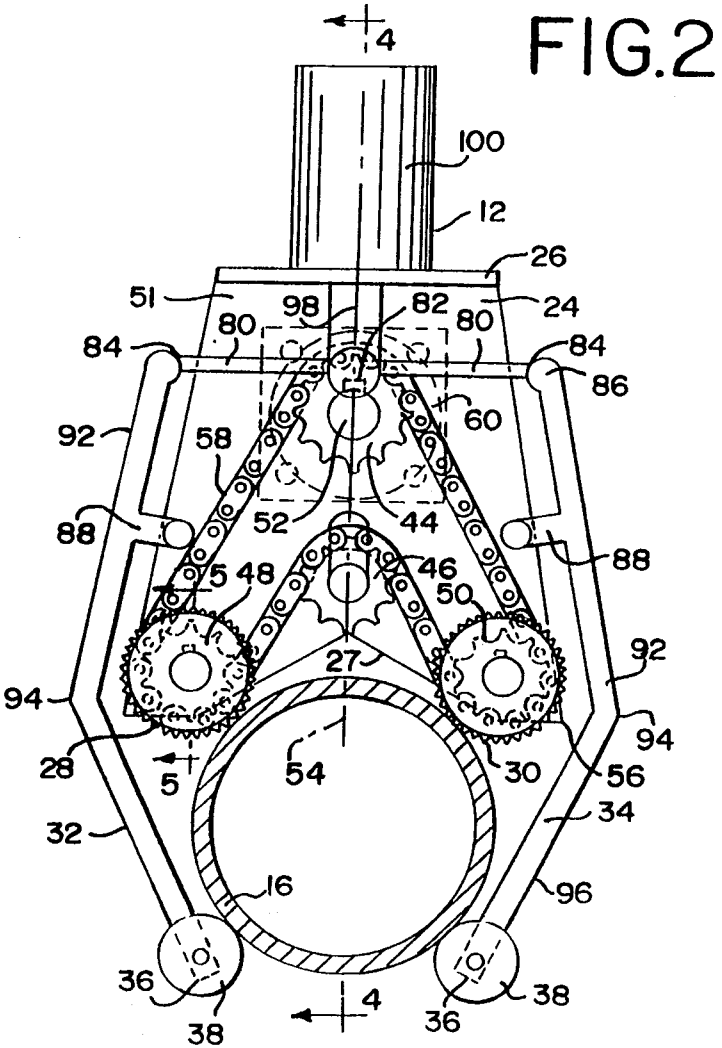
FIG. 2 is an end view of one of the end units of FIG. 1 with its end cover plate removed for clarity of illustration, showing one position of the guide arms of this embodiment of the present invention.

As shown in FIG. 1, each end unit 12 includes a frame 22 and cover plate 23. The frame 22 is L-shaped in cross-section and comprises a planar base plate 24 and a top plate 26. The planar base plate 24 has a bottom edge 27. As shown in FIG. 2, each end unit also includes a first and second drive wheel 28, 30 mounted for rotation on each planar base plate 24 and guide means attached to the base for movement to a position wherein the pipe is held against the drive wheels. In the first illustrated embodiment, the guide means comprises a pair of guide arms 32, 34 pivotally mounted on the planar base plate 24. Each guide arm 32, 34 has a free end 36, and a guide roller 38 is mounted for free rotation at the free ends 36 of the guide arms 32, 34. The illustrated guide rollers 38 are cylindrical and are rotatable about an axis perpendicular to the planar base plate 24. Each end unit 12 also includes means for rotating the drive wheels.

While it is desirable that the guide arms hold the pipe against the drive wheels while allowing for free rotation of the pipe, anti-friction means other than the illustrated guide rollers may be employed in the present invention.

Figures 3, 4, 5:
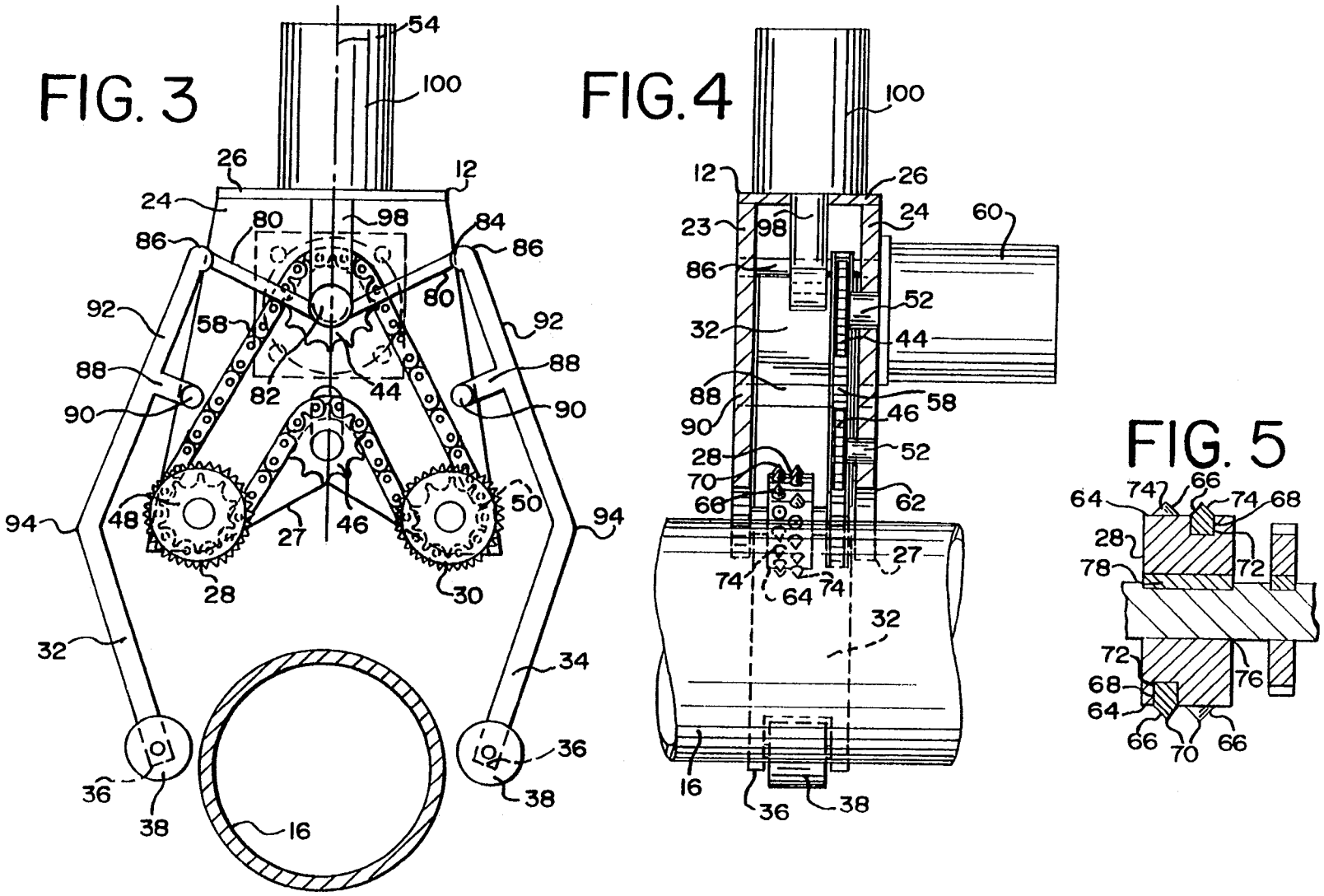
FIG. 3 is an end view of one of the end units of FIG. 1 with its end cover plate removed for clarity of illustration, showing a second position of the guide arms of this embodiment of the present invention.
FIG. 4 is a cross section taken along line 4—4 of FIG. 2.
FIG. 5 is a cross section taken along line 5—5 of FIG. 2, showing a cross section of one of the drive wheels.

The free end 36 of each guide arm 32, 34 extends beyond the planar base plate 24, and when in the positions shown in FIGS. 2 and 3, the free ends 36 extend beyond the bottom edge 27 of the base plate 24. The guide arms 32, 34 are pivotable on the base plate 24 between a first position, shown in FIG. 3, wherein the free ends 36 of the guide arms 32, 34 are spaced from each other a distance greater than the diameter of the elongate pipe 16, and a second position, shown in FIG. 2, wherein the free ends 36 of the guide arms 32, 34 are spaced from each other a distance less than the diameter of the elongate pipe 16. In the second position, the free ends 36 of the guide arms 32, 34 are also spaced from the drive wheels 28, 30 so that the elongate pipe 16 is captured between the drive wheels 28, 30 and the guide rollers 38, as shown in FIG. 2, to hold the elongate pipe 16 against the drive wheels.

It will be understood by those in the art that it is not necessary that the end units 12 be identical. For example, one of the end units 12 could simply comprise means for supporting the elongate pipe 16, allowing for rotation of the pipe. Such means could include a plurality of guide rollers or wheels.

In the illustrated embodiment, the means for rotating the drive wheels 28, 30 includes a plurality of sprockets 44, 46, 48, 50 which are attached to one side 51 of the planar base plate 24. All of the sprockets 44, 46, 48, 50 are mounted for rotation on the planar base plate 24, with the axes of rotation 52 being perpendicular to the planar base plate 24. These sprockets are arranged so that the second drive wheel rotates with the rotation of the first drive wheel. The first and second sprockets 44, 46 are vertically aligned along the vertical centerline 54 of the planar base plate 24, with the first sprocket 44 being positioned proximate to the top plate 26 and the second sprocket 46 being positioned below the first sprocket 44. The third and fourth sprockets 48, 50 are horizontally aligned and are positioned at the bottom outside corners 56 of the planar base plate 24. A continuous drive chain 58 extends around the sprockets, with the second sprocket 46 serving as an idler and to position the drive chain away from the pipe. The bottom edge 27 of the planar base plate 24 is offset toward the top plate 26 at the vertical centerline 54 of the planar base plate 24 so that the planar base plate does not interfere with or contact the pipe 16.

The first sprocket 44 is driven by a first hydraulic motor 60 mounted on the opposite side 62 of the planar base plate 24. The hydraulic motor 60 turns the first sprocket 44, which drives the continuous drive chain 58 to turn the third and fourth sprockets 48, 50.

The two drive wheels 28, 30 are mounted coaxially with the third and fourth sprockets 48, 50 respectively, and the drive wheels 28, 30 rotate with the rotation of the third and fourth sprockets 48, 50. Thus, the first hydraulic motor's 60 driving of the first sprocket and drive chain causes the drive wheels 28, 30 to rotate. Both drive wheels rotate in unison, in the same direction.

It will be understood by those skilled in the art that other means for rotating the drive wheels may be employed. For example, a non-hydraulic motor may be used, and different arrangements of sprockets can be used. In some uses, it may not be necessary to employ two drive wheels; if only one drive wheel is employed, a motor could be used to directly rotate this drive wheel without using sprockets and a drive chain. A motor could be connected to directly drive one of the drive wheels with a drive chain or spur gears to drive the second drive wheel. Instead of a drive chain and sprockets, a spur gear arrangement could be used to drive both the drive wheels. Instead of a drive chain, a notched belt motor could be used.

As shown in FIGS. 4 and 5, each drive wheel has a cylindrical outer surface 64, a portion of which extends below the bottom edge 27 of the planar base plate 24. Each drive wheel 28, 30 is keyed to the common axle with the sprockets 48, 50 so that the drive wheels rotate with the sprockets.

The drive wheels 28, 30 frictionally engage the outer surface of the elongate pipe 16 to turn the pipe with rotation of the drive wheels. In the embodiment shown in FIGS. 2–4, each drive wheel 28, 30 has a plurality of projections 66 extending radially outward from the outer cylindrical surface 64 of the drive wheel to contact the outer surface of the elongate pipe 16. As shown in FIG. 5, each projection 66 comprises a discrete pencil-shaped member, preferably a hardenable steel alloy such as AISI (American Iron and Steel Institute) A2, having a cylindrical base 68 and a pointed end 70. The cylindrical base 68 is press-fit into a complementary hole 72 formed in the drive wheel at the outer cylindrical surface 64 of the drive wheel. Each hole 72 is directed radially toward the longitudinal centerline of the drive wheel. The holes are all at an approximately equal depth and the projections are all similarly sized so that the tips 70 of the projections all reach about the same radial distance from the longitudinal centerline of the drive wheel. The projections are sized so that they extend beyond the base, and thereby extend beyond the bottom edge 27 of the base plate to contact the pipe 16.

The material chosen for use in connection with the drive wheels should be a frictional material that will not produce unacceptable damage to the pipe, will wear well and will produce sufficient friction to turn the pipe. The illustrated AISI A2 projections are acceptable for turning soft iron pipe, galvanized pipe and "black" pipe. The present invention is not limited to use of the illustrated AISI A2 projections: the material chosen will depend upon the end use and the types of pipe to be positioned and turned. Other frictional materials other than the illustrated AISI A2 projections may be used advantageously.

As shown in FIGS. 4 and 5, two rows 74 of projections 66 are provided on each drive wheel 28, 30. The projections 66 are in two circumferential rows 74 around the outer surface of each drive wheel, and the circumferential rows are staggered. In the illustrated embodiment, there are eighteen projections per row 74. The projections are sized and spaced so that the effective outer diameter of each drive wheel is at the pointed ends 70 of the projections 66. The pointed ends 70 of the projections 66 contact the outer surface of the elongate pipe 16 to turn the pipe with rotation of the drive wheels 28, 30.

Each drive wheel 28, 30 has an outer diameter of about two and one-quarter inches measured to the outer cylindrical surface 64 of the drive wheel, and an effective outer diameter, measured to the pointed ends 70 of the projections 66, of about two and one-half inches. Thus, each projection 66 extends about one-eighth inch outward from the outer cylindrical surface 64 of the drive wheel 28, 30.

Each drive wheel also has an central axial opening 76 to accommodate the common axle shared with the respective third and fourth sprockets 48, 50. The central axial opening 76 of each drive wheel has a key slot 78 for registering with a key on the axle for driving the drive wheel.

In the embodiment illustrated in FIGS. 2–4, each end unit 12 contains a pair of toggle arms 80, joined end to end by a toggle arm pivot joint 82. The opposite ends 84 of the toggle arms 80 are connected to the guide arms 32, 34 through a set of guide arm pivot joints 86 opposite the free ends 36 of the guide arms. The toggle arms 80 can pivot relative to each other about the toggle arm pivot joint 82 about an axis perpendicular to the base plate 24, and the guide arms 32, 34 can pivot relative to the toggle arms 80 on the guide arm pivot joints 86 about an axis perpendicular to the base plate 24.

Each guide arm 32, 34 can be pivoted to a position wherein the guide rollers 38 hold the elongate pipe against the projections 66 on the outer surface 64 of each drive wheel 28, 30. The guide arms can be pivoted on the base plate 24 between a first position, shown in FIG. 3, wherein the free ends 80 of the guide arms are spaced from each other a distance greater than the diameter of the elongate pipe and a second position, shown in FIG. 2, wherein the free ends 36 of the guide arms are spaced from each other a distance less than the diameter of the elongate pipe and spaced from the drive wheels 28, 30 to capture the elongate pipe between the drive wheels and guide rollers at the free ends of the guide arms.

Each guide arm 32, 34 includes a short side arm 88 either attached to or integral with the guide arm. The side arms 88 extend laterally from each guide arm toward the vertical centerline 54 of the base plate 24, and are rotatably connected to the base plate 24 through an axle 90 extending through an aperture in the side arm so that the side arms rotate about an axis perpendicular to the base plate. The axles are connected to or integral with the base and are perpendicular to the base plate 24. The axles are spaced apart and are horizontally aligned on the base plate 24 above the drive wheels 28, 30. Bolts extending through bores in the base plate may be used for the axles.

As shown in FIG. 2, the guide arms 32, 34 are mounted to the base so that one guide arm 32 is proximate to the first drive wheel 28 and the second guide arm 34 is pivotally mounted to the base proximate to the second drive wheel 30. Each guide arm can be pivoted to the position shown in FIG. 2, where the first guide arm's 32 guide roller is diametrically opposite the second drive wheel 30 and the second guide arm's 34 guide roller is diametrically opposite the first drive wheel 28.

The guide arms 32, 34 are shaped to diverge away from the base plate 24, and then converge toward the base past the side arms 88 so that the guide arms are spaced from the drive wheels; thus the drive wheels may rotate free from interference from the guide arms in both the first and second positions, as shown in FIGS. 2 and 3. The shape of the guide arms also allows the pipe to turn freely without interference from the guide arms. As shown in FIGS. 2 and 3, each guide arm 32, 34 is shaped to define an obtuse angle past the side arm 88, with long straight segments 92 extending from the guide arm pivot joint 86 to a bend 94 and straight segments 96 extending from the bend 94 to the free ends 36. As shown in FIGS. 2 and 3, the side arms 88 are attached to or integral with the long straight segments 92 of the guide arms.

In the illustrated embodiment, a reciprocatable ram arm 98 is connected to the pivot joint 82 between the toggle arms 80. Means for driving the reciprocatable ram in a direction perpendicular to the axes of rotation of the toggle arm pivot joint and guide arm pivot joints are provided. The driving means causes the guide arms to pivot between the first and second positions, shown in FIGS. 2 and 3. In the illustrated embodiment, the reciprocatable ram arm 98 is driven by a hydraulic piston 100 mounted on the top plate 26 of the frame 22. The hydraulic piston 100 receives hydraulic fluid through the hydraulic fluid lines 18. The hydraulic ram operates to exert force upon the toggle arm pivot joint 82 between the toggle arms 80, the force being generally parallel to the plane of the base plate 24. The toggle arm pivot joint 82 is moveable along the vertical centerline 54 of the base plate 24, and is moved by the action of the hydraulic ram 98, which selectively pushes or pulls against the toggle arm pivot joint 82, to open and close the guide arms. Other means for driving the reciprocatable ram may be employed.

In operation, to grab a pipe, the pipe turner 10 is attached to the free end of the arm of a back hoe or the like, and the back hoe arm is then moved to position the pipe turner proximate to the pipe. The hydraulic pistons 100 on the top plates 26 of both end units 12 are activated to push the reciprocatable ram arm 98 away from the top plate 26 and toward the pipe 16. This movement of the ram 98 causes the toggle arms 80 to pivot relative to each other on the pivot joint 82 and relative to the guide arms 32, 34 on the pivot joints 86. The movement of the toggle arm pivot joint 82 away from the top plate 26 moves the guide arm pivot joints 86 toward the vertical centerlines 54 of the base plates 24, causing the guide arms 32, 34 to pivot on the axles 90, and thereby causing the free ends 80 of the guide arms to separate. After the distance between the free ends 80 of the guide arms is greater than the pipe 16 diameter, the free ends of the guide arms may be placed around the pipe, and the operation of the hydraulic piston reversed.

In reverse operation, the hydraulic pistons 100 operate to pull the ram arms 98 back toward the top plates 26 of the frames 22. The ram arms 98 thereby pull the toggle arm pivot joints 82 back toward the top plates 26, which pull the toggle arms 80 and thereby push the guide arm pivot joints 86 away from the vertical centerlines 54 of the base plates 24. As the guide arm pivot joints 86 are pushed away from the vertical centerlines of the base plates, the guide arms 32, 34 rotate on the axles 90 and the free ends 80 of the guide arms 32, 34 move toward the vertical centerlines 54 of the base plates 24 so that the free ends of the guide arms close around the pipe 16. This operation is continued until the pipe 16 is held relatively tightly between the guide rollers 38 at the free ends 80 of the guide arms 32, 34 and the pointed ends 70 of the projections 66 on the drive wheels 28, 30. When the pipe is so held, with the guide rollers 38 below the horizontal centerline of the pipe 16, the hydraulic pistons may be deactivated and the pipe may be transported and positioned where desired.

Once the pipe is properly positioned, the hydraulic motors 60 on the opposite sides 62 of the base plates 24 may be activated to turn the first sprockets 44 to drive the continuous drive chain 58. The continuous drive chain causes the third 48 and fourth 50 sprockets to rotate, which rotate the drive wheels 28, 30. The rotating pointed ends 70 of the projections 66 act against the outer surface of the elongate pipe 16, causing the pipe 16 to rotate so that the pipe may thereby be threaded onto another pipe.

As can be seen in FIG. 2, the guide arms 32, 34 are sized and shaped to support the pipe in position against the projections 66 on the drive wheels 28, 30 while minimizing interference with the rotation of the pipe by the guide arms. The guide rollers 38 are large enough so that the pipe's outer surface rests against the guide rollers without contacting the guide arms. The bend 94 in the guide arms spaces the guide arms from the pipe and from the rotating sprockets 48, 50 and drive wheels 28, 30. The second sprocket 46 prevents interference or contact between the pipe and the drive chain 58 by positioning the drive chain away from the pipe.

The overall size of the end units should be determined by the space requirements in the intended end use. Where the pipe grabbing and turning device is to be used in installing pipe in a duct bank of relatively closely spaced pipe, the end units may be sized to fit within the expected space requirements.

It will be recognized by those skilled in the art that variations on the discloses embodiment may be employed without departing from the spirit and scope of the invention. For example, only one of the end units may have the drive wheels for turning the pipe, or the drive mechanism could be centrally disposed on the rods 14 with the guide arms for holding the pipe and allowing it to rotate being spaced from the drive mechanism. Moreover, in some applications, as for example where dimpling of the surface of the pipe could occur and be undesirable, it may be desirable to employ drive wheels having a high coefficient of friction rather than drive wheels having pointed projections.

Figure 6:
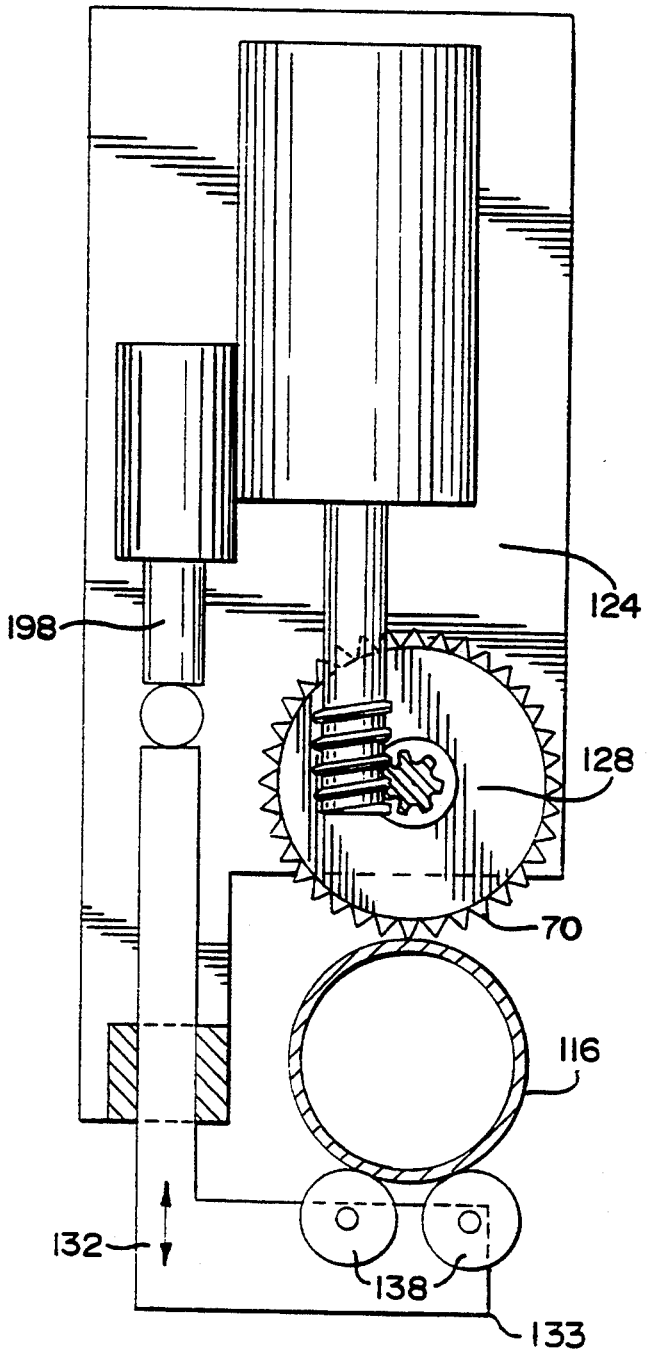
FIG. 6 is a plan view of another embodiment of the present invention, with a cover removed for clarity of illustration.

One possible variation is illustrated in FIG. 6, which shows a hand held pipe turner. In that embodiment, the guide means comprises a single L-shaped guide arm 132 which has a pair of guide rollers 138 mounted for free rotation on the free leg 133 of the guide arm. Opposite the guide rollers 138, a single drive wheel 128 is mounted for rotation on a base plate 124. The guide arm 132 is moveable between a position wherein the guide rollers hold the pipe 116 tightly against the drive wheel for turning the pipe, and a position wherein the guide rollers allow the pipe to be removed from the unit. In the illustrated embodiment, the guide arm 132 is reciprocatable between these two positions. A reciprocatable ram 198, powered by an hydraulic piston, may be used for moving the guide arm between the two positions, and the drive wheel may be powered by an hydraulic motor.

Although this invention has been disclosed and described in its preferred forms with a certain degree of particularity, it is understood that the present disclosure of the preferred form is only by way of example and that numerous changes in the details of operation and in the combination and arrangement of parts may be made without departing from the spirit and scope of the invention as hereinafter claimed.

We claim:

1. A tool for turning an elongate pipe, the tool comprising:

a base having a bottom edge;

a pair of guide arms, each guide arm having a free end;

means for pivotally mounting each guide arm to the base, each guide arm being mounted so that the free ends of the guide arms extend beyond the base;

a guide roller rotatably mounted at each free end of each guide arm;

a first drive wheel mounted for rotation on the base, the drive wheel being positioned so that a portion of the drive wheel extends beyond the bottom edge of the base, the drive wheel serving to frictionally engage the elongate pipe to turn the elongate pipe with rotation of the drive wheel;

the guide arms being pivotable on the base between a first position wherein the free ends of the guide arms are spaced from each other a distance greater than the diameter of the elongate pipe and a second position wherein the free ends of the guide arms are spaced from each other a distance less than the diameter of the elongate pipe and spaced from the drive wheel to capture the elongate pipe between the drive wheel and guide rollers at the free ends of the guide arms;

wherein the guide arms have ends opposite the free ends, the tool further comprising:

a pair of toggle arms pivotally connected in an end to end relationship;

a toggle arm pivot joint connecting the two adjacent ends of the toggle arms;

guide arm pivot joints pivotally connecting the opposite ends of the guide arms to the toggle arms;

the toggle arm pivot joint and guide arm pivot joints having parallel axes of rotation;

a reciprocatable ram connected to the toggle arm pivot joint;

means for driving said reciprocatable ram to move in a direction perpendicular to the axes of rotation of the toggle arm pivot joint and guide arm pivot joints to cause the guide arms to pivot between said first and second positions.

2. A tool as claimed in claim 1 wherein said means for driving said reciprocatable ram comprises an hydraulic piston.

3. A tool as claimed in claim 1 further comprising a second drive wheel mounted for rotation on the base, the second drive wheel being positioned so that a portion of the second drive wheel extends beyond the base, the second drive wheel serving to frictionally engage the elongate pipe to turn the pipe with rotation of the second drive wheel, said second drive wheel being spaced from and aligned with said first drive wheel.

4. A tool as claimed in claim 3 wherein the means for pivotally mounting each guide arm to the base includes a side arm extending laterally from each guide arm and axles extending from the base through an aperture in the side arm in a direction parallel with the axes of rotation of the toggle arm pivot joint and guide arm pivot joints, the axles being spaced apart and aligned on the base and each axle being disposed proximate to one of the drive wheels opposite the bottom edge of the base.

5. A tool as claimed in claim 4 wherein the guide arms diverge away from the base and then converge toward the base past the side arms so that the guide arms are spaced from the drive wheels so that the drive wheels may rotate free from interference from the guide arms in both said first and second positions.

6. A tool as claimed in claim 1 further comprising means for connecting the tool to a manipulator arm.

7. A tool for turning an elongate pipe, the tool comprising:

a first and a second end unit;

a connecting member connecting the end units;

said first end unit including:

a base;

a pair of guide arms, each guide arm having a free end;

means for pivotally mounting each guide arm to the base, each guide arm being mounted so that the free ends of the guide arms extend beyond the base;

anti-friction means at each free end of each guide arm;

a first drive wheel mounted for rotation on the base for contacting a portion of an elongate pipe and for turning the pipe with the rotation of the first drive wheel;

the guide arms being pivotable on the base between a first position wherein the free ends of the guide arms are spaced from each other a distance greater than the diameter of the elongate pipe and a second position wherein the free ends of the guide arms are spaced from each other a distance less than the diameter of the elongate pipe and spaced from the drive wheel to capture the elongate pipe between the drive wheel and the anti-friction means at the free ends of the guide arms;

said second end unit including means for supporting the elongate pipe, said supporting means allowing for rotation of the pipe;

and wherein said tool includes means for rotating the first drive wheel.

8. A tool for turning an elongate pipe as claimed in claim 7 wherein said second end unit includes:

a base;

a pair of guide arms, each guide arm having a free end;

means for pivotally mounting each guide arm to the base, each guide arm being mounted so that the free ends of the guide arms extend beyond the base;

anti-friction means at each free end of each guide arm;

the guide arms being pivotable on the base between a first position wherein the free ends of the guide arms are spaced from each other a distance greater than the diameter of the elongate pipe and a second position wherein the free ends of the guide arms are spaced from each other a distance less than the diameter of the elongate pipe.

9. A tool for turning an elongate pipe as claimed in claim 8 wherein said second end unit includes:

a first drive wheel mounted for rotation on the base for contacting a portion of the elongate pipe and for turning the pipe with the rotation of the first drive wheel; and wherein said tool includes means for turning the drive wheel of the second end unit.

10. A tool for turning an elongate pipe as claimed in claim 9 wherein each end unit further includes:

a second drive wheel rotatably mounted on each of said bases, each of said second drive wheels being spaced from the first drive wheels for contacting portions of the elongate pipe for turning the pipe with the rotation of the second drive wheels; and means for rotating the second drive wheels with the rotation of the first drive wheels.

11. A tool for turning an elongate pipe as claimed in claim 10 wherein all of the drive wheels have cylindrical outer surfaces and include projections comprising a plurality of discrete elements having a projection base and a pointed end, the projection bases being held within complementary radially-directed holes in the outer surfaces, the projections being disposed in two circumferential rows around the outer surface of each drive wheel, the circumferential rows of projections being staggered.

12. A tool for turning an elongate pipe as claimed in claim 11 wherein each end unit includes:

a pair of toggle arms pivotally connected in an end to end relationship;

a toggle arm joint connecting the two adjacent ends of the toggle arms;

guide arm pivot joints connecting the guide arms to the toggle joints;

the toggle arm pivot joints and the guide arm pivot joints having parallel axes of rotation;

a reciprocatable ram connected to the toggle arm pivot joint;

means for driving said reciprocatable ram to move in a direction perpendicular to the axes of rotation of the toggle arm pivot joint and guide arm pivot joints to cause the guide arms to pivot between said first and second positions.

13. A tool for turning an elongate pipe as claimed in claim 11 wherein said means for rotating said first drive wheel and means for rotating the second drive wheel with the rotation of the first drive wheel comprise:

first sprockets rotatably mounted on each of said bases;

motors to cause each of said first sprockets to rotate;

second sprockets rotatably mounted on each of said bases and being vertically aligned with the first sprocket on each of said bases;

third sprockets rotatably mounted on each of said bases coaxial with the first drive wheel on each of said bases so that the first drive wheel on each of said bases rotates with the rotation of each of the third sprockets;

fourth sprockets rotatably mounted on each of said bases coaxial with the second drive wheel on each of said bases so that the second sprocket on each of said bases rotates with the rotation of the fourth sprockets; and drive chains in each end unit extending from the first sprocket to the third sprocket to the second sprocket to the fourth sprocket to cause the second, third and fourth sprockets to rotate with the rotation of the first sprockets.

14. A tool as claimed in claim 13 wherein the means for pivotally mounting each guide arm to each base includes side arms extending laterally from each guide arm and axles extending from the base through apertures in the side arms in a direction parallel with the axes of rotation of the toggle arm pivot joints and guide arm pivot joints, the axles being spaced apart and aligned on the base and each axle being disposed proximate to one of the drive wheels, the guide arms diverging away from the base and then converging toward the base past the side arms so that the guide arms are spaced from the drive wheels so that the drive wheels may rotate free from interference from the guide arms in both said first and second positions.

15. A tool as claimed in claim 7 further comprising means for connecting the tool to a manipulator arm.

16. A tool for turning an elongate pipe as claimed in claim 7 wherein the anti-friction means comprises a guide roller mounted for free rotation at each free end of each guide arm.

17. A tool for turning an elongate pipe as claimed in claim 7 wherein the connecting member comprises a pair of parallel rods extending between the first and second end units.

18. A tool for turning an elongate pipe as claimed in claim 17 further comprising a means for connecting the tool to a manipulator arm, said means for connecting being attached to the parallel rods midway between the first and second end units.

19. A tool for turning an elongate pipe, the tool comprising:

a base;

a first drive wheel mounted for rotation on the base;

means for rotating the first drive wheel;

a pair of guide arms pivotally mounted to the base, each guide arm having a free end and an opposite end;

anti-friction means on each guide arm;

the guide arms being pivotable between a position wherein the free ends of the guide arms are spaced from each other a distance greater than the diameter of the elongate pipe and a second position wherein the free ends of the guide arms are spaced from each other a distance less than the diameter of the elongate pipe and the anti-friction means is spaced from the drive wheel to capture the elongate pipe between the drive wheel and the antifriction means;

toggle arms pivotally connected to the opposite ends of the guide arms;

a pivot joint connecting the toggle arms; and a reciprocatable ram connected to the pivot joint between the toggle arms to cause the guide arms to pivot between the first and second positions by pulling and pushing on the pivot joint.

20. A tool as claimed in claim 19 further comprising a side arm extending laterally from each guide arm and pivotally mounted to the base, and wherein each guide arm is shaped to define an obtuse angle diverging toward the base with its vertex between the side arm and the free end of the guide arm.

* * * * *